US006215390B1

(12) United States Patent
Lin

(10) Patent No.: US 6,215,390 B1
(45) Date of Patent: Apr. 10, 2001

(54) DART TARGET WITH A FUNCTION OF DISPLAYING SCORES

(76) Inventor: Brown Lin, No. 20-4, Alley 1, Lane 217, Sec. 3, Chung-Hsiao E. Rd., Taipei (TW)

( * ) Notice: Subject to any disclaimer, the term of this patent is extended or adjusted under 35 U.S.C. 154(b) by 0 days.

(21) Appl. No.: 09/451,120

(22) Filed: Nov. 30, 1999

(51) Int. Cl.[7] ..... G08B 23/00

(52) U.S. Cl. ..... 340/323 R; 340/815.47; 273/374; 273/371

(58) Field of Search ..... 340/323 R, 815.47; 273/371, 373, 374, 375, 376

(56) References Cited

U.S. PATENT DOCUMENTS

| | | | | |
|---|---|---|---|---|
| 4,974,857 | * | 12/1990 | Beall et al. | 273/371 |
| 4,976,441 | * | 12/1990 | Kim | 273/376 |
| 5,560,617 | * | 10/1996 | Liang | 273/376 |
| 5,788,244 | * | 8/1998 | Hui et al. | 273/374 |
| 6,045,132 | * | 4/2000 | Giegerich | 273/408 |
| 6,047,968 | * | 4/2000 | Lu et al. | 273/371 |

* cited by examiner

*Primary Examiner*—Jeffery A. Hofsass
*Assistant Examiner*—Sihong Huang
(74) *Attorney, Agent, or Firm*—Dougherty & Troxell

(57) ABSTRACT

A dart target with a function of automatically displaying scores is disclosed. The dart target is installed with a damping panel. The damping panel is formed by at least one damping layer; the damping layers are made of flexible and transmitted cloth, such as sisal, non-woven cloth, etc. Thus, metal dart can be used. As the dart passes through the target panel, it can be damped by the damping layer and fixed. A pattern is formed at the surface of the first damping layer so that the dart player may identify the target. The target panel is a plane for being used by metal dart needle, and the score can be displayed properly. The target unit is constructed by a sisal block and a frame box. On the bottom side of the frame box, there are a plurality of protrusions opposite to the switches formed on an electric circuit panel, when the needle of a dart stabs into a target unit, the momentum of dart would press the dart, and then the protrusions on the frame box press the touch switches formed on the electric circuit panel, the electric circuit then operates to show the scores on the displayers. A damping net is installed at the front end of the displaying panel; when the metal dart head impinges into the target, by the damping of the damping net, the displaying panel will not be harmed.

5 Claims, 6 Drawing Sheets

DART TARGET WITH A FUNCTION OF DISPLAYING SCORES

FIELD OF THE INVENTION

The present invention relates to a dart target with a function of automatically displaying scores, and especially to a low cost and convenient dart target with a high efficiency.

BACKGROUND OF THE INVENTION

In the prior art, the conventional dart has a metal tip, and the target body is made of a sisal block without a function of displaying score.

FIGS. 1A and 1B shows another prior art dart toy which is primarily formed by target body 21. The target body 21 includes a plurality of targets 201, 202, 203, . . . , with holes therein, a dart frame 23. The targets 201, 202, 203, . . . are located in an object frame 20. On the target body 21, a score display 24 and a plurality of buttons are installed. When the tip of the dart 25 inserts into the holes 201A, 201B, . . . of the targets, it will touch switch 26 in the target 26 so that the switch is closed. Then a signal will pass through the wire 27 to a processing circuit. Then, the signal is connected to a score display 24 for displaying the score.

However some defects is existed in this prior art design.

1. In order that as the tip of the dart inserts into the targets, it will not destroy the switch, and is fixed therein, the tip of the dart needle generally must be made of nylon. However, such material is easily broken or bent so as not to be sustained in equilibrium as a large force is applied on the dart.

2. A plurality of holes must be formed on the target, the cost is high.

SUMMARY OF THE INVENTION

Accordingly, the primary object of the present invention is to provide a dart target with a function of automatically displaying scores. The dart target is installed with a damping panel. The damping panel is formed by at least one damping layer; the damping layers are made of flexible and transmitted cloth, such as sisal, non-woven cloth, etc. Thus, a metal dart can be used. As the dart passes through the target panel, it can be damped by the damping layer and fixed therein. A pattern is formed at the surface of the first damping layer so that the dart player may identify the target. The target panel is a plane for being used by metal dart head, and the score can be displayed properly.

Another object of the present invention is to provide a dart target with a function of automatically displaying scores, wherein a damping net is installed at the front end of the displaying panel. When the metal dart head impinges into the target, by the damping of the damping net, the displaying panel will not be harmed. Therefore, a low cost and convenient dart target with a high efficiency is provided by the present invention.

The various objects and advantages of the present invention will be more readily understood from the following detailed description when read in conjunction with the appended drawing.

DETAILED DESCRIPTION OF THE PREFERRED EMBODIMENTS

Figure 1B:
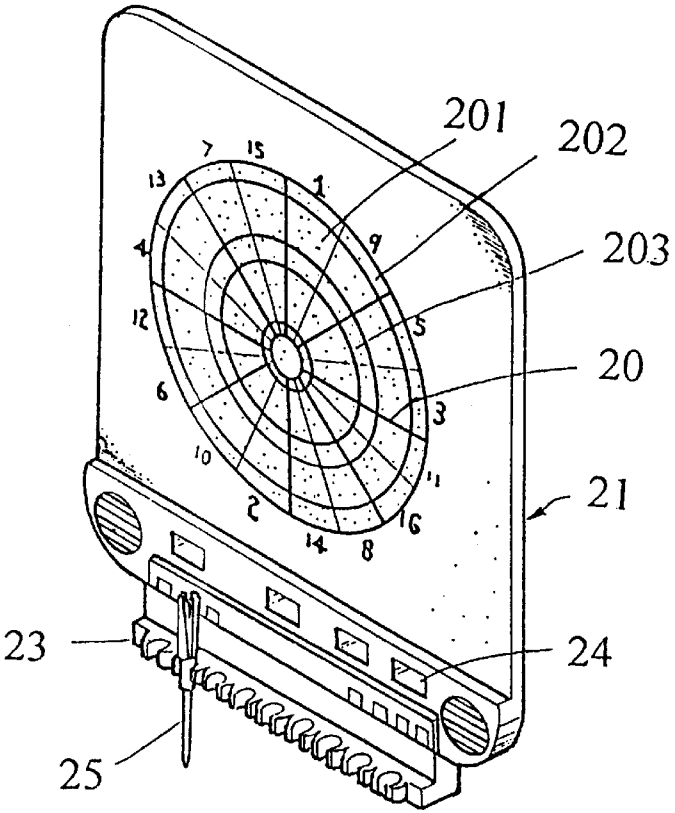
FIG. 1B (Prior Art)
FIGS. 1A and 1B is a cross sectional view of a prior art dart toy.
Figure 1A:
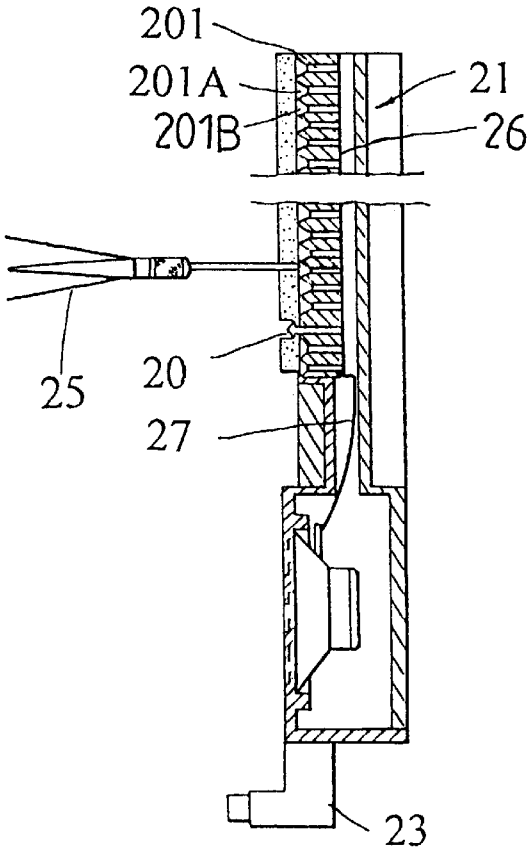
FIG. 1A (Prior Art)
Figure 2:
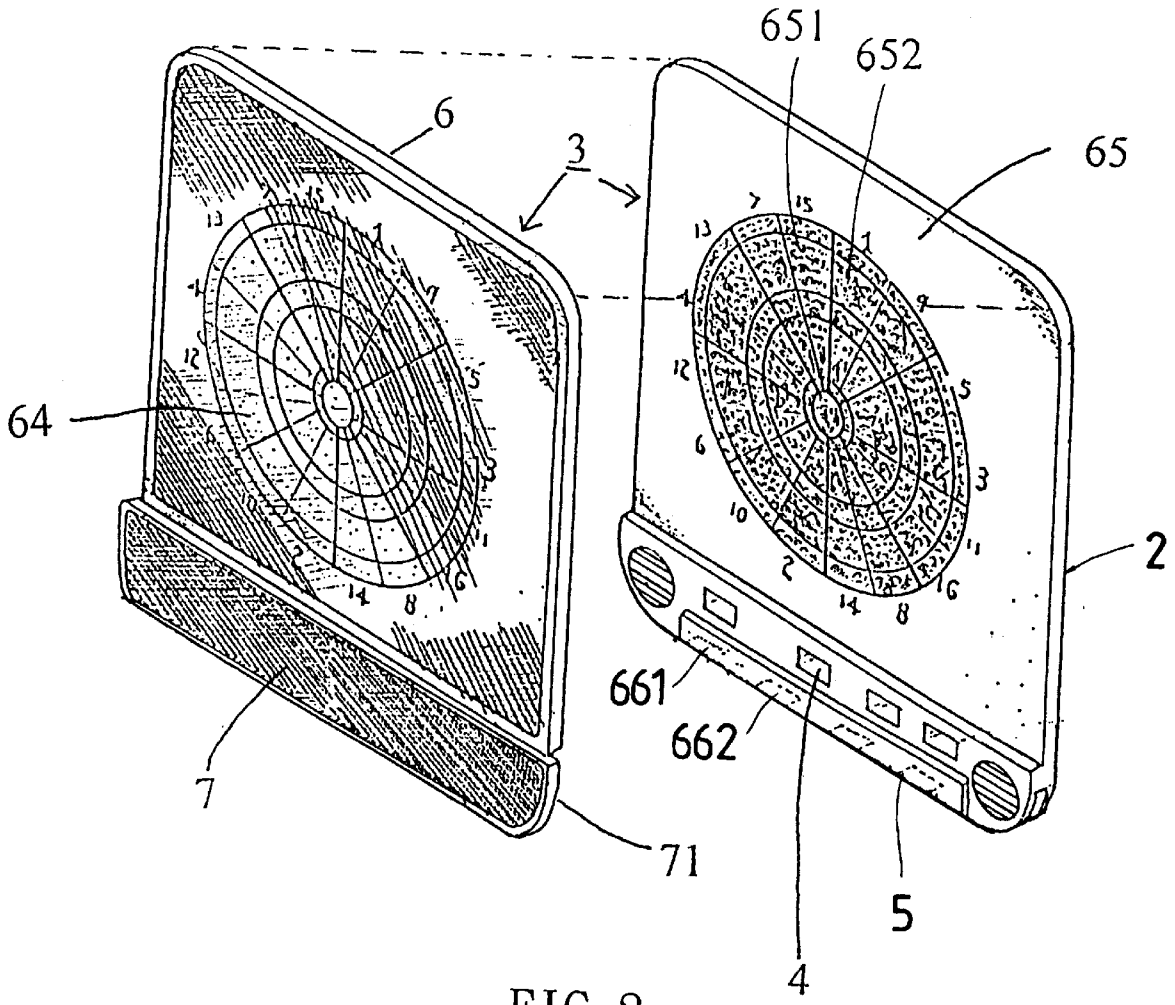
FIG. 2 is a perspective view of the present invention.
Figure 7:
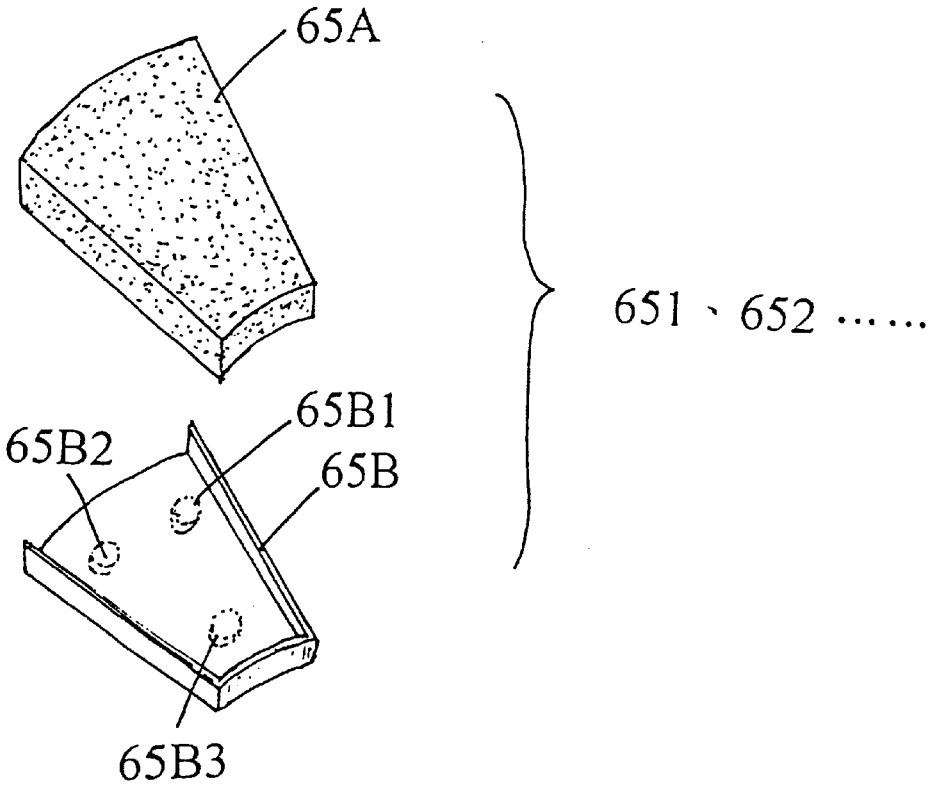
FIG. 7 is a perspective view showing the construction of target unit.

With reference to FIG. 2, the improved dart target with a function of automatically displaying scores according to the present invention is illustrated. The dart target has a target body 2. The upper end of the target body 2 has a plurality of target units 3, and the lower end of the target body 2 has a display panel for displaying scores or indication for the dart player. Some buttons 5 are installed at the lower edge of side of the target body 2, there are also some drawers 661, 662 . . . for keeping dart accessories. The target 3 includes a damping panel 6, a target panel 65, and a panel having a touch controlled electric circuit 67, etc. The target panel 65 is divided into a plurality of target sections for clearing classifying according to the scores. In each of target section, a target unit 651 or 652 . . . is inserted. As shown in FIG. 7, each of the target units 651, 652 . . . is constructed by a sisal block 65A and a frame box 65B for holding the sisal block. Under the frame box 65B, there are a plurality of protrusions $65B_1$, $65B_2$, $65B_3$ . . . ; each of the protrusions $65B_1 65B_2$, $65B_3$ . . . is opposite to a touch switch formed on said electric circuit, such that when needle of a dart stabs into the sisal target unit 65A, the momentum of dart would press the frame box 65B which is holding a sisal block 65A, and then the protrusions on the frame box press the touch switches formed on the electric circuit panel 67, the electric circuit then operate to show the scores on the displayers 4. The target panel is matched with the touch controlled circuit to display the score, this is known in the prior art, and thus, the detail will not be further described herein.

Figure 3:
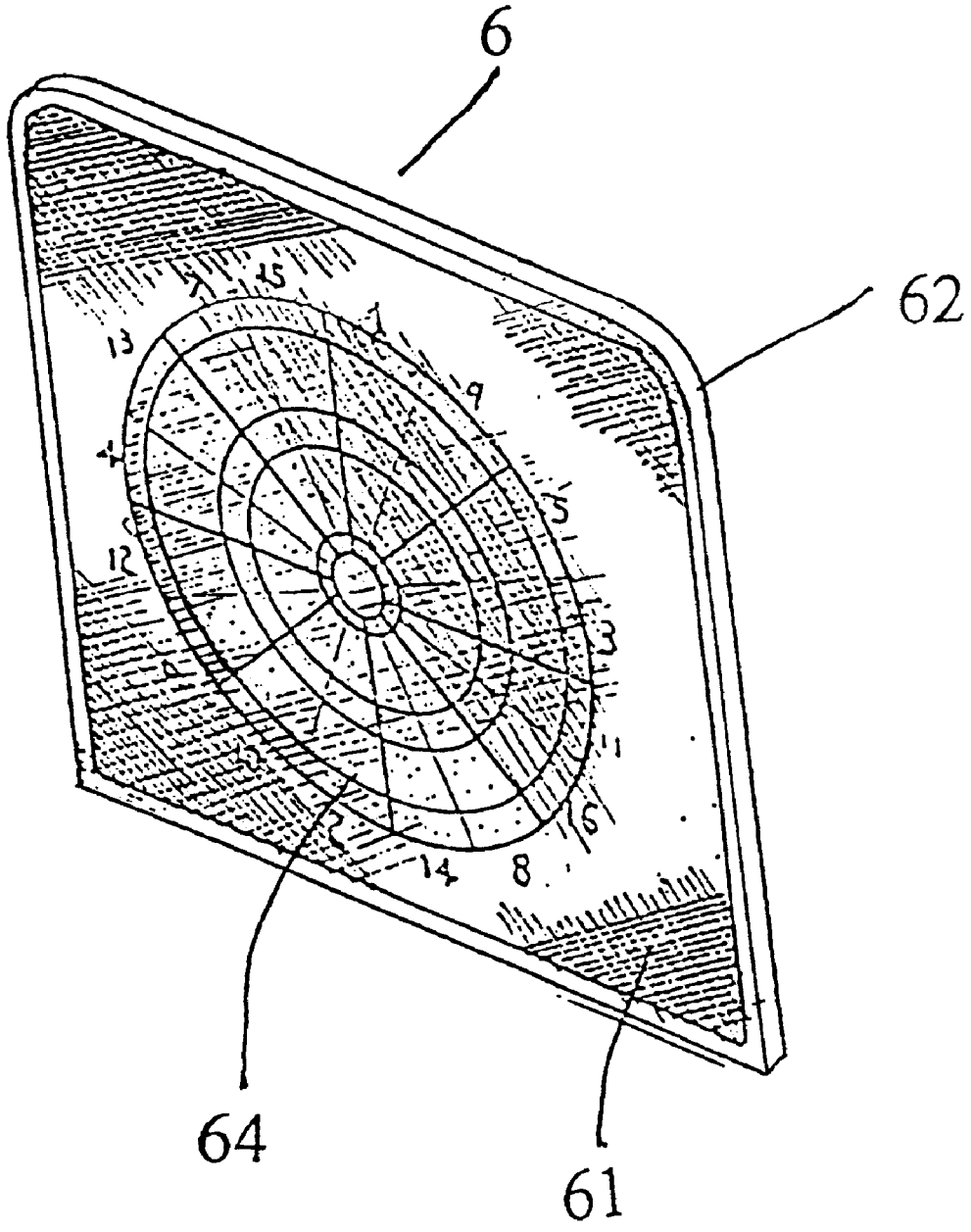
FIG. 3 is a perspective view showing the damping panel of the present invention.
Figure 4:
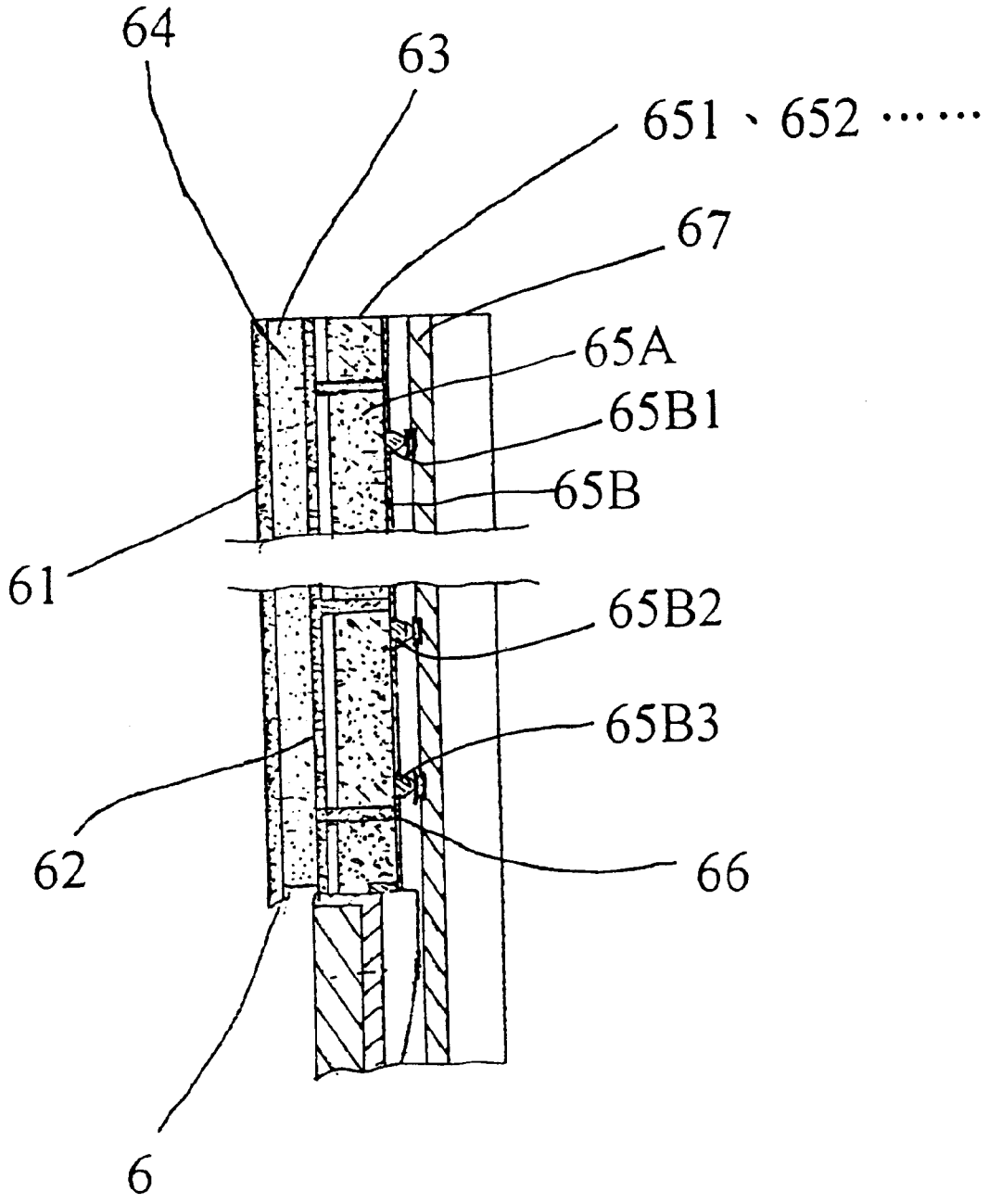
FIG. 4 is a partial cross sectional view of the target in the present invention.

With reference to FIG. 3, the damping panel 6 is formed by two damping layers. The damping layers are made of flexible and transmitted cloth, such as sisal, non-woven cloth, etc. The first damping layer 61 is a surface layer which is flat by expanding and fixing. The second damping layer 62 is a liner which is retained in a loose condition. The first damping layer 61 and the second damping layer 62 are sustained in a fixed distance. Foam and other damping material is filled within the space between the two layers. Therefore, with damping panel 6, a proper damping force is formed. A pattern 64 is formed at the surface of the first damping layer 61 and the pattern 64 is identical to the target section and the frame so that the dart player may identify the target.

Next, since the target panel 65 is unnecessary to fix the dart head, a plane panel is sufficient.

With reference to FIG. 2, a damping net 7 is installed at the front end of the displaying panel, which is made of nylon or other material which may damp the applied force of metal darts. The periphery thereof is fixed to the lower end of the target by a frame 71 so as to retain a proper distance with the displaying panel 4. Thus, when the metal dart head impinges into the target, by the damping of the damping net 7, the displaying panel will not be harmed.

Figure 5:
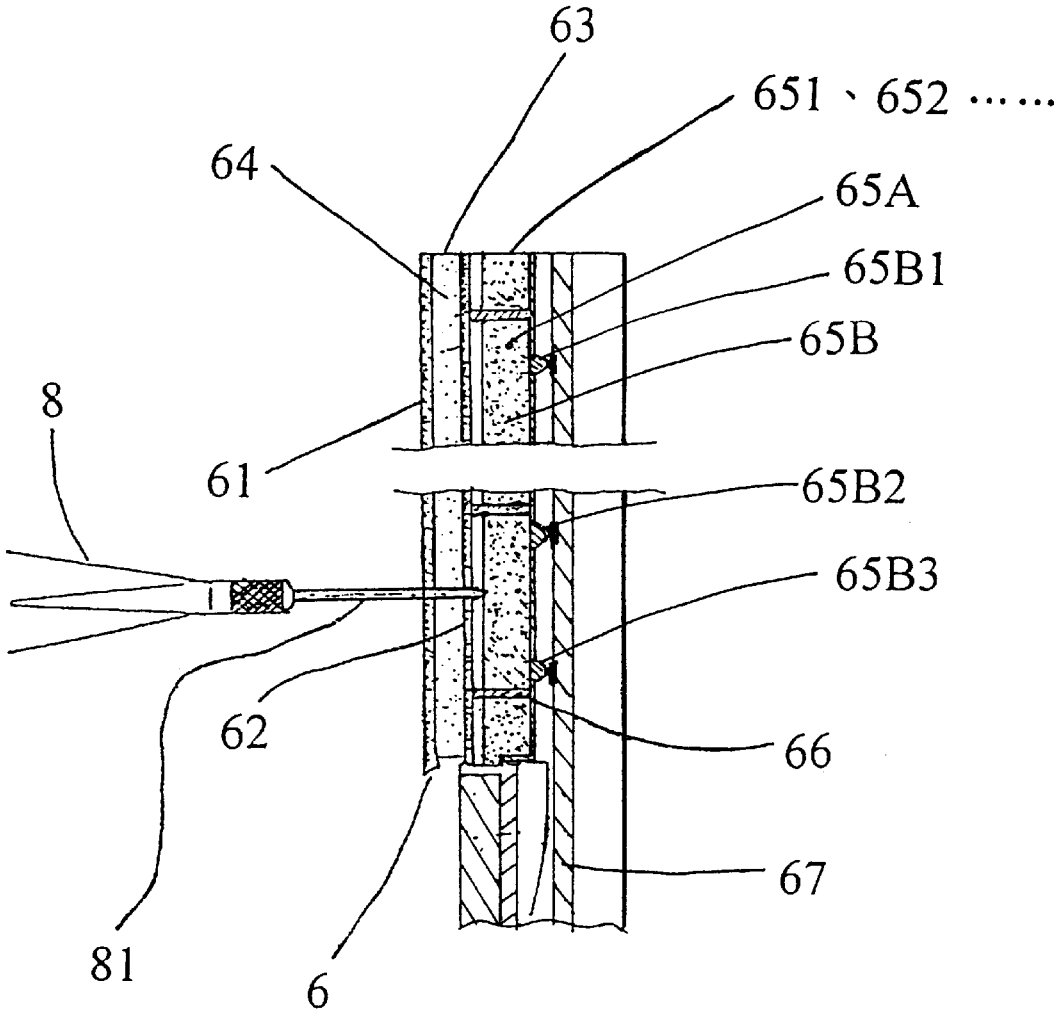
FIG. 5 is a partial cross sectional view showing the application the present invention.
Figure 6:
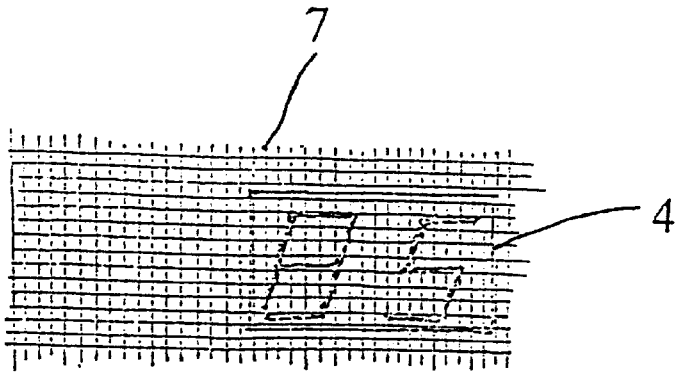
FIG. 6 shows the displayed score can be seen outside the damping net.

With reference to FIG. 5, when a dart player uses the present invention, the dart player may view of the pattern 64 of the target sections on the damping layer of the damping panel to select the object. Moreover, by the pattern on the damping panel, the dart player can know the score. As the metal dart 8 is shot, the metal dart head 81 firstly passes through the damping panel, the first damping layer, damping materials, and second damping layer so that the shooting force is reduced and the dart is fixed. Since the height of the damping panel is preset to be lower than the length of the metal dart head, the front end of the metal dart head can properly touch the target panel so as to touch the touch controlled circuit. By the displaying panel 4, score is displayed, as shown in FIG. 6, which can be viewed outside the damping net 7.

The loose state of the second damping layer can be performed by nail fixing or by hanging.

By the aforesaid description, it is apparent that the target of the present invention with a function of automatically displaying scores has the following advantages:

1. The target panel is unnecessary to be formed with many holes, and thus, the manufacturing cost is reduced.
2. By using a metal dart, the lifetime of the dart can be prolonged.
3. The cost of the damping panel is cheap, and thus, the updating cost is also low.
4. By the damping net, the displaying panel can be protected effectively.
5. The drawers would prevent the inconvenience happened in searching dart accessories.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A dart target for automatically displaying scores, comprising:

a target panel having a plurality of target units inserted into target sections formed on the target panel, each target unit comprising a sisal block held in a frame box with an outer side having a plurality of protrusions;

a plurality of touch switches formed on an electric circuit panel, such that when needle of a dart stabs into the sisal block of the target unit, momentum causes the protrusions on the frame box to press the touch switches formed on the electric circuit panel;

an electric circuit connected to the electric circuit panel and the touch switches to show scores on score displays;

a damping panel disposed adjacent to the target panel and comprising first and second spaced apart damping layers, with the second damping layer closest to the target panel being retained in a loose condition;

a displaying panel having score displays thereon and located on the target panel; and a damping net installed at a front side of the displaying panel, the damping net comprising a material which damps the applied force of metal darts, a periphery thereof being fixed to a lower end of the target panel by a frame, thus, when the metal dart head impinges into the target panel, the damping net prevents the displaying panel from being harmed.

2. The dart target for automatically displaying scores as claimed in claim 1, wherein the first and second damping layers are made of flexible cloth.

3. The dart target for automatically displaying scores as claimed in claim 1 further comprising a foam damping material filled in the space between the spaced apart first and second damping layers.

4. The dart target for automatically displaying scores as claimed in claim 1, wherein the first damping layer is flat and fixed.

5. The dart target for automatically displaying scores as claimed in claim 1, wherein the target panel further comprises drawers for keeping darts and dart accessories.

* * * * *